United States Patent [19]

Clark

[11] Patent Number: 4,534,873

[45] Date of Patent: Aug. 13, 1985

[54] AUTOMOTIVE FRICTION REDUCING COMPOSITION

[76] Inventor: Gary G. Clark, 107 E. F, South Hutchinson, Kans. 67505

[21] Appl. No.: 536,652

[22] Filed: Sep. 28, 1983

[51] Int. Cl.[3] ..... C10M 1/10; C10M 1/48

[52] U.S. Cl. ..... 252/32.7 E; 252/18

[58] Field of Search ..... 252/32.7 E, 18

[56] References Cited

U.S. PATENT DOCUMENTS

| | | | |
|---|---|---|---|
| 2,030,832 | 2/1936 | MacLaren | 208/18 |
| 2,410,652 | 11/1946 | Griffin, Jr. | 252/33.4 |
| 2,977,305 | 3/1961 | Abbott | 252/32.7 |
| 2,993,856 | 7/1961 | Heisig | 252/32.7 |
| 3,077,452 | 2/1963 | Fainman | 252/59 |
| 3,250,711 | 5/1966 | Early | 252/37.2 |
| 3,368,971 | 2/1968 | Retzloff | 252/33.4 |
| 3,652,410 | 3/1972 | Hollinghurst et al. | 252/32.7 E |
| 3,681,247 | 8/1972 | Wann | 252/51.5 A |
| 3,775,321 | 11/1973 | Turnquest | 252/42.7 |
| 3,775,324 | 11/1973 | McCoy et al. | 252/54.6 |
| 3,873,455 | 3/1975 | Schieman | 252/32.7 E |
| 4,090,970 | 5/1978 | Braid | 252/42.7 |
| 4,163,729 | 8/1979 | Adams | 252/18 |
| 4,376,711 | 3/1983 | Shaub | 252/32.7 E |

*Primary Examiner*—William R. Dixon, Jr.
*Assistant Examiner*—Margaret B. Medley
*Attorney, Agent, or Firm*—Banner, Birch, McKie and Beckett

[57] ABSTRACT

A friction reducing additive for addition to the lubricating oil crankcase of an internal combustion engine, such as in an automobile, is provided. The additive comprises (a) a hydrocarbon oil of lubricating viscosity; (b) an extreme pressure antiwear agent comprising: (i) an oil dispersion of solid inorganic film-forming potassium borate, (ii) antimony diaklylphosphorodithioate, and (iii) a liquid chlorinated paraffin; (c) an alkaline material; and (d) a viscosity index improver. The preferred additive composition of the present invention also contains an antioxidant and an antifoaming agent.

30 Claims, No Drawings

AUTOMOTIVE FRICTION REDUCING COMPOSITION

TECHNICAL FIELD

The present invention relates to a novel lubricating composition for use in oil lubricated internal combustion engines. More particularly, the present invention relates to a friction and wear reducing additive which can be added directly to an engine crankcase.

BACKGROUND OF THE INVENTION

Lubricating oils for use in internal combustion engines such as those in the automobile are normally formulated with various additives to improve their properties under engine operating conditions. While commercially available motor oils of both petroleum and synthetic origin provide good lubrication for the metal parts of an internal combustion engine, it has long been recognized that friction and wear properties of these motor oils have not been optimized. Accordingly, the art has developed a number of products which can be added directly to the oil in the crankcase by the ultimate consumer. These crankcase additives are said to reduce friction and to provide improved engine wear characteristics to the base motor oil. As a practical matter, however, many of the commercially available crankcase additives do not significantly improve motor oil performance and in some cases may actually reduce the performance characteristics of the base motor oil to which they are added. Thus, there is a significant need for a friction reducing additive which can be added directly to motor oil in the crankcase to improve performance characteristics without introducing any of the deleterious effects caused by the prior art crankcase additives.

SUMMARY OF THE INVENTION

Accordingly, it is an object of the present invention to provide a friction reducing crankcase additive imparting improved performance characteristics to any base motor oil while not adversely affecting the performance of this oil.

More specifically, it is an object of the present invention to provide an automotive friction reducing additive which will reduce wear on primary metal-to-metal surfaces and therefore increase engine life.

It is another object of the present invention to provide an automotive friction reducing additive which will significantly increase fuel mileage in an automotive engine.

A further object of the present invention is to provide an automotive friction reducing additive which results in reduced engine temperature during operation.

Moreover, it is an object of the present invention to provide an automotive friction reducing additive which results in increased engine performance and reduced engine noise and roughness.

It is another object of the present invention to provide an automotive friction reducing additive which prevents acid and water corrosion of metal surfaces in the automotive engine.

These and other objects which will be readily apparent to one of ordinary skill in the art are achieved by providing a friction reducing additive composition which comprises (a) a hydrocarbon oil of lubricating viscosity; (b) an extreme pressure antiwear agent comprising a mixture of (i) an oil dispersion of solid, film-forming potassium borate, (ii) antimony dialkylphosphorodithioate, (iii) liquid chlorinated paraffin; (c) an alkaline additive; and (d) a viscosity index improver. The preferred additive composition of the present invention also contains an antioxidant and an antifoaming agent. The additive composition of the present invention is preferably added at a level of about 3 to 12 percent by volume to five quarts of engine oil.

DETAILED DESCRIPTION OF THE INVENTION

The friction reducing additive composition of the present invention is unique in that it is specially formulated to treat the metal surfaces in the engine rather than simply the oil itself. Accordingly, the increased friction reducing properties of the additive according to the present invention remain even after the oil in the crankcase is changed. As described in more detail later, the friction reducing additive of the present invention significantly enhances the performance characteristics of motor oil and surpasses commercially available crankcase additives in a significant number of performance categories. The additive of this invention can be used in any oil lubricated internal combustion engine (e.g., gasoline or diesel), including by way of example only, engines in automobiles, trucks, airplanes, boats, motorcycles, lawn mowers, chain saws and the like. The preferred utility is for use as a crankcase additive for automotive engines.

The friction reducing additive of the present invention comprises as its essential components a hydrocarbon oil of lubricating viscosity, a specific multi-component extreme pressure antiwear additive, an alkaline additive, and a viscosity index improver. Also preferably incorporated into this additive composition are an antioxidant and an antifoam agent.

The additive of the present invention is added to the motor oil in an amount sufficient to provide the desired friction reducing characteristics depending on the nature of the engine, the base motor oil and intended operating conditions. In general, the additive can comprise from about 3 to about 12 percent by volume of the oil/additive mixture, with the preferred additive level being from about 5 to 10 percent by volume. Most preferred is an additive level of about 7 percent by volume.

A convenient manner to supply this additive for automotive use is in a 12 ounce container, which when added to 4 to 5 quarts of engine oil, provides the requisite additive amounts.

The hydrocarbon oil of lubrication viscosity employed as the base for the additive of the present invention may be of paraffinic or naphthenic base as well as synthetic bases. The preferred oils are solvent neutral oils which are commercially available and comprise a premium quality, highly refined paraffinic base oil generally having a viscosity level between 62 and 650 SUS at 100° F. Preferred are solvent neutral oils having a viscosity in the range of about 100 to 200 SUS at 100° F. with the most preferred being an oil having a viscosity having about 150 SUS at 100° F. One such oil is available from Sun Petroleum Products Company of Tulsa, Okla., under the grade designation SN150. In general, the solvent neutral oil component can comprise from about 20 to about 65 percent by volume of the additive product. Preferred are oil levels of from about 30 to about 55 percent by volume, with the most preferred level being about 50 percent by volume. When this additive is added to a base motor oil the level of solvent neutral oil can range in general from about 1.4 to about 5.0 percent by volume. The preferred solvent neutral oil level in the crankcase product is from about 2.1 to about 4.0 percent by volume, with the most preferred level being about 3.5 percent by volume.

The second major ingredient of the friction reducing additive composition of the present invention is an extreme pressure antiwear agent which comprises three specific components. Applicant has found that the combination of these three components results in a product superior to prior art lubricating composition containing one or more of these components.

The first of the extreme pressure antiwear components used according to the present invention is a borate additive. This additive is available as a borate lubricating oil additive in the form of an oil dispersion of small amorphous inorganic borate spheres averaging about 0.1 micrometers in diameter. The preferred form of this product is essentially potassium borate and is available from Chevron Chemical Company of San Francisco, Calif., as OLOA 9750. This additive has both exceptional stability and load carrying capacity. The microspheres interact with metal load bearing surfaces to form a film of extraordinary resilience under extreme pressure conditions. This borate additive has many advantages over traditional solid film-forming additives such as graphite and molybdenum disulfide, i.e., increased EP protection at lower viscosity, excellent thermal and oxidative stability, high temperature noncorrosivity, good elastomer compatability, and no sulfur odor. In general, the borate component can comprise from about 2 to about 25 percent by volume of the additive product. Preferred borate levels are from about 10 to about 15 percent by volume, with the most preferred level being about 12.5 percent by volume. The additive-containing motor oil according to the present invention can comprise from about 0.14 to about 1.8 percent by volume of the borate component. The preferred level of borate in the oil is from about 0.7 to about 1.1 percent by volume, with the most preferred level being about 0.9 percent by volume.

The second extreme pressure antiwear component employed according to the present invention is antimony dialkylphosphorodithioate, which has the following formula:

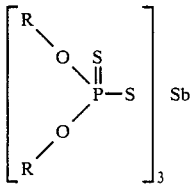

This material is commercially available from a number of sources including the R. T. Vanderbilt Company, Inc., of Norwalk, Conn. as VANLUBE ® 622. In general, the antimony dialkylphosphorodithioate component can comprise from about 1 to about 20 percent by volume of the additive product. Preferred levels of this component are from about 5 to about 10 percent by volume, with the most preferred level being about 6.2 percent by volume. The additive-containing motor oil according to the present invention can comprise from about 0.07 to about 1.4 percent by volume of this component. The preferred level in the oil is from about 0.3 to about 0.7 percent by volume, with the most preferred level being about 0.4 percent by volume.

The third extreme pressure antiwear component employed in the composition of the present invention is a liquid chlorinated paraffin. Preferred are paraffin materials having a chlorine content between about 39 and 70 percent by weight and a viscosity between 450 and 70,000 SUS at 100° F. Such a product is available from Diamond Shamrock of Cleveland, Ohio as CHLOROWAX ® 42-170. In general, the chlorinated paraffin component can comprise from about 2 to about 35 percent by volume of the additive product. Preferred paraffin levels are from about 10 to about 20 percent by volume, with the most preferred level being about 12.5 percent by volume. The additive-containing motor oil according to the present invention can comprise from about 0.14 to about 2.5 percent by volume of the chlorinated paraffin component. The preferred level of this component in the oil is from about 0.7 to about 1.4 percent by volume, with the most preferred level being about 0.9 percent by volume.

The next major ingredient of the composition of the present invention is an alkaline additive. This alkaline material performs the function of neutralizing acidic components generated during engine operation, and is especially important due to the acidity created by the liquid chlorinated paraffin in the composition of the present invention. Any of the commonly employed alkaline oil additives may be employed as this ingredient. Examples of such additives include calcium sulfonate, overbased calcium sulfonate, barium sulfonate, overbased barium sulfonate, overbased magnesium sulfate, barium phosphonate, calcium phenate and the like. In general, these alkaline materials can have a total base number (TBN) between about 10 and 400 with the preferred materials having a TBN in the range of about 200 to 350. The most preferred ingredient is an overbased calcium sulfonate having a TBN of about 300 such as the product known as LUBRIZOL ® 74 available from Lubrizol Corp., Wickliffe, Ohio. In general, the alkaline component can comprise from about 0.4 to about 20 percent by volume of the additive product. Preferred alkaline levels are from about 2 to about 10 percent by volume, with the most preferred level being about 4.2 percent by volume. The additive-containing motor oil according to the present invention can comprise from about 0.03 to about 1.4 percent by volume of the alkaline component. The preferred level of this component in the oil is from about 0.14 to about 0.7 percent by volume, with the most preferred level being about 0.3 percent by volume.

The fourth major ingredient of the composition of the present invention is a viscosity index improver. This material should have a viscosity level between about 480 and 1600 cSt at 100° C. and preferably has a viscosity in the range of about 1015 and 1250 cSt at 100° C., with the most preferred viscosity level being at about 1150 cSt at 100° C. Among the viscosity index improvers which can be employed are olefin copolymers, polyisobutylene, methacrylic copolymers, polymethacrylate, methacrylate terpolymers, and polybutenes. The preferred viscosity index improver for use according to the present invention is an olefin copolymer such as the one designated TLA-347A available from the Texaco Chemical Company, Houston, Tex. In general, the olefin copolymer component can comprise from about 4 to about 35 percent by volume of the additive product. Preferred olefin copolymer levels are from about 10 to about 25 percent by volume, with the most preferred level being about 12.5 percent by volume. The additive-containing motor oil according to the present invention can comprise from about 0.3 to about 2.5 percent by volume of the olefin copolymer component. The preferred level of this component in the oil is from about 0.7 to about 1.8 percent by volume, with the most preferred level being about 0.9 percent by volume.

A preferred optional ingredient employed according to the composition of the present invention is an antioxidant additive. Any of the known classes of antioxidant additives may be employed as long as they are otherwise compatible with the components in the composition of the present invention. Among these antioxidants are various aryl amines such as alkylated diphenylamines, including octylated and nonylated diphenylamines (e.g., p,p'-dioctyldiphenylamine and dinonyldiphenylamine); dithiocarbamate derivatives such as zinc diamyldithiocarbamate and 4,4'-methylene bis(dibutyldithiocarbamate); blends of substituted diphenylamines and zinc dithiocarbamate; 2,6-di-t-butyl-p-cresol; polymerized 1,2-dihydro-2,2,4-trimethylquinoline; 4,4'-methylene bis(2,6-di-t-butylphenol); sulfur-phosphorus type antioxidants and the like. Preferred are amine antioxidants such as aryl amines, alkylated diphenylamines, octylated diphenylamines, and monoalkene thiophosphonates. The preferred amine antioxidant has a nitrogen content between about 1 to about 5 percent by weight and preferably with the range of 2.2 to 4.2 percent by weight. One preferred antioxidant is an aryl amine such as that available from Lubrizol Corporation of Wickliffe, Ohio, as Lubrizol 5150A. Another suitable amine antioxidant is sold under the name of VANLUBE® NA by the R. T. Vanderbilt Company of Norwalk, Conn. (an alkylated diphenylamine). In general, the antioxidant component can comprise from about 0 to about 20 percent by volume of the additive product. Preferred antioxidant levels are from about 1 to about 10 percent by volume, with the most preferred level being about 2.1 percent by volume. The additive-containing motor oil according to the present invention can comprise from about 0 to about 1.4 percent by volume of the antioxidant component. The preferred level of this component in the oil is from about 0.07 to about 0.7 percent by volume, with the most preferred level being about 0.2 percent by volume.

The composition of the present invention also preferably contains an antifoaming agent. Preferred are silicone based antifoaming materials such as Dow Corning® 200 FLUID available from Dow Corning Corp. of Midland, Mich., which is a dimethyl siloxane polymer. These antifoaming agents are preferably employed at conventional levels, e.g., about 20 ppm in the additive composition of the present invention.

Another suitable defoamant is sold under the name of Mobilad® C-402 by the Mobil Chemical Company of Edison, N.J., which is a solution of polymeric defoamant containing no silicones. The recommended treating levels are between 500–1,000 ppm, or 500 ppm of Mobilad® C-402 mixed with a silicone defoamant like Dow Corning® 200 FLUID at half the recommended silicone treat rate. Other antifoaming agents, of course, could be employed.

The automotive friction reducing composition of the present invention is prepared by blending the above-described components at an elevated temperature. In general, the preferred method of the present invention comprises blending the solvent neutral oil, the potassium borate, the antimony dialkylphosphorodithioate, the liquid chlorinated paraffin and the olefin copolymer at an elevated temperature not exceeding about 150° F. and preferably not exceeding about 135° to about 140° F. The mixture is then cooled to a temperature in the range of from about 90° to about 100° F. after which the optional antioxidant, the alkaline additive and the antifoaming agent are added. In the most preferred method, the solvent neutral oil is heated to a temperature in the range of about 100° to 110° F. The potassium borate is then blended into the heated oil while maintaining the temprature at about 105° to 115° F. The mixture is then heated to about 110° to 125° F. and the antimony dialkylphosphorodithioate is blended into the mixture. After heating to a temperature of about 120° to 130° F. the liquid chlorinated paraffin is blended into the mixture. The mixture is then heated to a temperature in the range of about 130° to 140° F. and the olefin copolymer is added. The resulting mixture is then cooled to a temperature in the range of from about 90° to about 100° F. and the remaining components are blended into the mixture.

The friction reducing additive composition of the present invention imparts significantly improved performance characteristics to automotive engine oil. Specifically, the product of the present invention exhibits lower carbon residue, good copper corrosion, exceptional extreme pressure wear prevention characteristics, and good coefficient of friction properties. As a result of these characteristics, use of the composition of the present invention as an additive to an automotive engine crankcase results in increased gas mileage, reduced engine operating temperatures, reduced wear on the primary metal-to-metal surfaces and increased engine life.

The following examples are intended to illustrate more fully the nature of the present invention without acting as a limitation on its scope.

EXAMPLE 1

This example demonstrates the preparation of a 12 ounce additive composition according to the present invention. The following ingredients in the amounts shown were combined with stirring in the order listed at the elevated temperatures shown:

| Ingredient | Amount | Temperature |
|---|---|---|
| Solvent neutral oil | 6 ozs. | 100–110° F. |
| Potassium Borate (EP Additive) | 1.5 ozs. | 105–115° F. |
| Antimony Dialkylphosphorodithioate (EP Additive) | 0.75 ozs. | 110–125° F. |
| Liquid Chlorinated Paraffin (EP Additive) | 1.5 ozs. | 120–130° F. |
| Olefin Copolymer (VI Improver) | 1.5 ozs. | 130–140° F. |
| Aryl Amine (Antioxidant) | .25 ozs. | 90–100° F. |
| Overbased Calcium Sulfonate | 0.5 ozs. | 90–100° F. |
| Silicone Antifoamant | 20 ppm | 90–100° F. |

The resulting product is stable for long periods of time.

EXAMPLE 2

This example demonstrates the preparation and the use of oil lubricating composition of the present invention. Twelve ounces of the composition of Example 1 was added to a standard motor oil (Quaker State) to give a composition of 5 quarts (160 oz.). This composition was subjected to the following standard performance tests:

Carbon Residue (Ramsbottom) ASTM D-524
Copper Corrosion ASTM D-130
Extreme Pressure Properties of Lubricating Fluids (Four-Ball Method) ASTM D-2783 (Weld and Load Wear Index)
Wear Preventive Characteristics of Lubricants ASTM D-2266 (Scar Diameter).

The additive-containing composition of the present invention was tested against a number of commercially available friction reducing additives and unmodified motor oils. The results of these tests are set out in Table 1. It can be seen that the product according to the present invention possesses superior overall performance characteristics.

While certain specific embodiments of the invention have been described with particularity herein, it will be recognized that various modifications thereof will occur to those skilled in the art. Therefore, the scope of the invention is to be limited solely by the scope of the appended claims.

TABLE 1

| Product | Carbon Residue (Ramsbottom) | Copper Corr. | EP Properties (Four Ball Weld & Load (Four Ball Index) | Coefficient of Friction Scar. Dia.) |
|---|---|---|---|---|
| *Present Invention | 1.19% | 1A | 315<br>63.46 | 0.39 mm |
| **WYNNS Friction proofing | 1.28% | 1A | 200<br>44.10 | 0.50 mm |
| **BARDAHL Oil Treatment 2 | 1.29% | 1A | 200<br>35.05 | 0.47 mm |
| **STP Oil Treatment | 1.22% | 1A | 200<br>44.45 | 0.45 mm |
| ***SLICK 50 TFE Resin Engine Coating | 2.14% | 1A | 200<br>39.55 | 0.45 mm |
| ****TMT Fluorocarbon Resin | 1.35% | 1A | 200<br>34.82 | 0.46 mm |
| ****FR III Friction Reducer | 1.30% | 1A | 200<br>42.26 | 0.44 mm |
| **MPG PLUS | 2.02% | 1A | 200<br>41.26 | 0.55 mm |
| **CD-2 Oil Treatment | 1.20% | 1A | 200<br>41.73 | 0.46 mm |
| **CASITE Motor Honey Oil Treatment | 1.18% | 1A | 200<br>42.21 | 0.43 mm |
| *****PENNZOIL | 1.50% | 1A | 200<br>45.20 | 0.53 mm |
| *****QUAKER STATE | 1.42% | 3A | 200<br>34.85 | 0.44 mm |

*7.5% Product in Quaker State Motor Oil
**10% Product in Pennzoil
***20% Product in Pennzoil
****5% Product in Pennzoil
*****100% Oil

I claim:

1. A friction reducing additive for direct addition to a lubricating oil crankcase, said additive comprising:
(a) a hydrocarbon oil of lubricating viscosity;
(b) an extreme pressure antiwear agent comprising a mixture of the following components:
(i) an oil dispersion of solid inorganic film-forming potassium borate;
(ii) antimony dialkylphosphorodithioate, and
(iii) a liquid chlorinated paraffin;
(c) an alkaline material in sufficient quantity for neutralizing acid components generated during use of said additive and having a total base number between about 10 and 400; and
(d) a viscosity index improving agent.

2. The friction reducing additive of claim 1 additionally comprising an antioxidant agent.

3. The friction reducing additive of claim 1 additionally containing an antifoam agent.

4. The friction reducing composition of claim 1 wherein said hydrocarbon oil is a solvent neutral oil.

5. The friction reducing additive of claim 1 wherein said alkaline additive is overbased calcium sulfonate.

6. The friction reducing additive of claim 1 wherein said viscosity index improving agent is an olefin copolymer.

7. The friction reducing additive of claim 2 wherein said antioxidant agent is an amine.

8. The friction reducing additive of claim 7 wherein said amine antioxidant is an aryl amine.

9. The friction reducing additive of claim 3 wherein said antifoam agent is a silicone based antifoamant.

10. A friction reducing additive for direct addition to an automotive lubricating oil crankcase, said additive comprising:
(a) from about 20 to about 65% by volume of a solvent neutral hydrocarbon oil of lubricating viscosity;
(b) from about 2 to about 25% by volume of an extreme pressure antiwear agent comprising an oil dispersion of inorganic, solid, film-forming potassium borate;
(c) from about 1 to about 20% by volume of an extreme pressure antiwear agent comprising antimony dialkylphosphorodithioate;
(d) from about 2 to about 35% by volume of an extreme pressure antiwear agent comprising a liquid chlorinated paraffin;
(e) from about 0.4 to about 20% by volume of overbased calcium sulfonate having a total base number between about 10 and 400, said calcium sulfonate being sufficient to neutralize acid components generated during use of said additive;
(f) from about 4 to about 35% by volume of an olefin copolymer viscosity improver;
(g) from about 0 to about 20% by volume of an aryl amine antioxidant agent; and
(h) about 20 ppm by weight of a silicone based antifoam agent.

11. A method for reducing friction and wear in an oil lubricated internal combustion engine, comprising adding to the engine oil in the crankcase of said engine from about 3 to about 12% by volume of an additive having the following composition:
(a) a hydrocarbon oil of lubricating viscosity;
(b) an extreme pressure antiwear agent comprising a mixture of the following components:
(i) an oil dispersion of solid, inorganic film-forming potassium borate;
(ii) antimony dialkylphosphorodithioate, and
(iii) a liquid chlorinated paraffin;
(c) an alkaline material in sufficient quantity for neutralizing acid components generated during use of said additive and having a total base number between about 10 and 400; and
(d) a viscosity index improving agent.

12. The method of claim 11 which said friction reducing additive additionally comprises an antioxidant agent.

13. The method of claim 11 wherein said friction reducing additive additionally comprises an antifoam agent.

14. The method of claim 11 wherein said hydrocarbon oil is a solvent neutral oil.

15. The method of claim 11 wherein said alkaline additive is overbased calcium sulfonate.

16. The method of claim 11 wherein said viscosity index improving agent is an olefin copolymer.

17. The method of claim 12 wherein said antioxidant agent is an amine.

18. The method of claim 17 wherein said amine antioxidant is an aryl amine.

19. The method of claim 13 wherein said antifoam agent is a silicone based antifoamant.

20. A lubricating composition for internal combustion engines, said composition comprising from about 3 to about 12% by volume of the additive composition of claim 1 blended with a lubricating oil formulated for use as an automotive motor oil in compliance with standards set out by the Society of Automotive Engineers.

21. A lubricating composition for internal combustion engines, said composition comprising from about 5 to about 10% by volume of the additive composition of claim 10 blended with a lubricating oil formulated for use as an automotive motor oil in compliance with standards set out by the Society of Automotive Engineers.

22. A method for producing a friction reducing composition comprising the steps of:

(a) blending (i) a hydrocarbon oil of lubricating viscosity, (ii) an oil dispersion of solid film-forming potassium borate, (iii) antimony dialkylphosphorodithioate, (iv) a liquid chlorinated paraffin, and (v) a viscosity index improver at an elevated temperature not exceeding about 150° F.;

(b) cooling the blend produced in step (a) to a temperature in the range of from about 90° to about 100° F.; and (c) adding to the cooled blend an alkaline material in sufficient quantity for neutralizing acid components generated during use of said friction reducing composition as an additive in automotive lubricating oil, said alkaline material having a total base number between about 10 and 400.

23. The method of claim 22 additionally comprising adding to said cooled blend an antioxidant agent.

24. The method of claim 22 additionally comprising adding to said cooled blend an antifoam agent.

25. The method of claim 22 wherein said hydrocarbon oil is a solvent neutral oil.

26. The method of claim 22 wherein said alkaline additive is overbased calcium sulfonate.

27. The method of claim 22 wherein said viscosity index improving agent is an olefin copolymer.

28. The method of claim 23 wherein said antioxidant agent is an amine.

29. The method of claim 28 wherein said amine antioxidant is an aryl amine.

30. The method of claim 24 wherein said antifoam agent is a silicone based antifoamant.

* * * * *